US006409153B1

(12) United States Patent
Norris

(10) Patent No.: US 6,409,153 B1
(45) Date of Patent: Jun. 25, 2002

(54) SMALL VEHICLE STORAGE LIFT

(76) Inventor: Kenneth D. Norris, 908 County Club La., Fort Worth, TX (US) 76112-1936

( * ) Notice: Subject to any disclaimer, the term of this patent is extended or adjusted under 35 U.S.C. 154(b) by 0 days.

(21) Appl. No.: 09/853,549

(22) Filed: May 14, 2001

(51) Int. Cl.[7] ..... B66F 3/24

(52) U.S. Cl. ..... 254/93 R; 254/2 B; 254/3 C; 254/129; 254/93 L; 254/89 H

(58) Field of Search ..... 254/93 R, 90, 254/91, 10 C, 3 C, 89 R, 93 L, 93 H, 99, 129, 133 R, DIG. 9, 2 B, 89 H

(56) References Cited

U.S. PATENT DOCUMENTS

| | | | | |
|---|---|---|---|---|
| 2,911,191 A | * | 11/1959 | Harman | 254/93 R |
| 4,531,614 A | * | 7/1985 | Naegeli | 254/2 B |
| 5,015,146 A | * | 5/1991 | Barnes et al. | 254/93 R |
| 5,174,415 A | * | 12/1992 | Neagle et al. | 254/2 B |
| 5,975,495 A | * | 11/1999 | Berends et al. | 254/2 B |

* cited by examiner

*Primary Examiner*—Joseph J. Hail, III
*Assistant Examiner*—Lee Wilson
(74) *Attorney, Agent, or Firm*—G. F. Gallinger

(57) ABSTRACT

An apparatus and method for storage of small vehicles in a garage where substantially all of the floor space is used to store other motor vehicles. An apparatus for lifting a small vehicle off a floor comprises: an upright track having a base anchored to the floor; a carriage slidably connected to the track; a deck frame carried by the carriage along one longitudinal side portion of the deck frame; and a motor for motivating the slide upwardly in the track thereby lifting the deck frame. Most preferably a top portion of the upright track is tipped laterally away from a bottom portion of the upright track so that as the carriage lifts the deck frame, the deck frame's center of gravity will tend to move above the base of the upright track. A method of lifting and storing a small vehicle to save floor space on a garage floor comprising the steps of using the above apparatus to lift the small vehicle. This method allows the garage floor beneath the lift to be used for parking automobiles.

13 Claims, 2 Drawing Sheets

SMALL VEHICLE STORAGE LIFT

FIELD OF THE INVENTION

This invention relates to the storage of motorcycles, snowmobiles, garden tractors, and lawn mowers. More particularly this invention relates to a method and apparatus for storage of such small vehicles in a garage where substantially all of the floor space is used to store automobiles.

BACKGROUND OF THE INVENTION

The inventor has a two car garage, two cars, and a motor cycle. The motor cycle is used mostly on summer weekends. The problem he is concerned with is the convenient storage of his motorcycle. His garage has insufficient floor space for all three of his vehicles. One solution is a shed; but a shed is less convenient, less secure, and relatively unsightly, especially if erected adjacent to a front driveway. What is needed is a method of and an apparatus for storing a small vehicle in a garage without substantially reducing the floor space therein available for parking automobiles.

OBJECTS OF THE INVENTION

It is an object of this invention to disclose a method of conveniently storing a small motor vehicle in a garage without substantially reducing the floor space therein available for parking automobiles. It is an object of this invention to disclose a method of storing a small motor vehicle in a position above an automobile parked thereunder. It is yet a further object of this invention to disclose an independently standing small motor vehicle lift. A lift which is constructed to allow a small vehicle to be loaded in a relatively central position in the garage and which horizontally retracts the vehicle towards a wall as it is lifted. In the storage position the weight of the vehicle is relatively laterally balanced about its anchored base thereby minimizing strain on its anchors in the garage floor. It is yet a further object of this invention to disclose a storage lift having built in wheel support locks for the lifted vehicle. It is yet a further object of this invention to disclose a lift utilizing a sufficiently thin platform so that a motor vehicle may drive over the platform when the platform is unloaded and in a lower position. It is a final object of this invention to disclose a storage lift having a lift platform having removable decking to facilitate the inspection and repair of small vehicles lifted therewith.

One aspect of this invention provides for a storage lift for lifting a small vehicle off a floor comprising: an upright track having a base anchored to the floor; a carriage slidably connected to the track; a deck frame carried by the carriage, said deck frame carried by and only by one longitudinal side portion of the deck frame; and, a deck lift means for motivating the carriage upwardly in the track thereby lifting the deck frame. Most preferably a top portion of the upright track is tipped laterally away from a bottom portion of the upright track so that as the carriage lifts the deck frame, the deck frame's center of gravity will tend to move above the base of the upright track.

A method of lifting and storing a small vehicle to save floor space on a garage floor comprising the following steps: anchoring a bottom end portion of an upright track to the floor along an edge portion of a garage floor, said upright track slidably guiding a carriage which carries a deck frame; positioning the small vehicle on the frame; and, finally lifting the deck frame and the small vehicle. This method allows the garage floor beneath the lifted small vehicle to be utilized for parking automobiles.

Various other objects, advantages and features of this invention will become apparent to those skilled in the art from the following description in conjunction with the accompanying drawings.

FIGURES OF THE INVENTION

FIG. 2 shows the attachment of the deck to the upright track, a d the attachment of the upright track to the floor.

Figure 1:
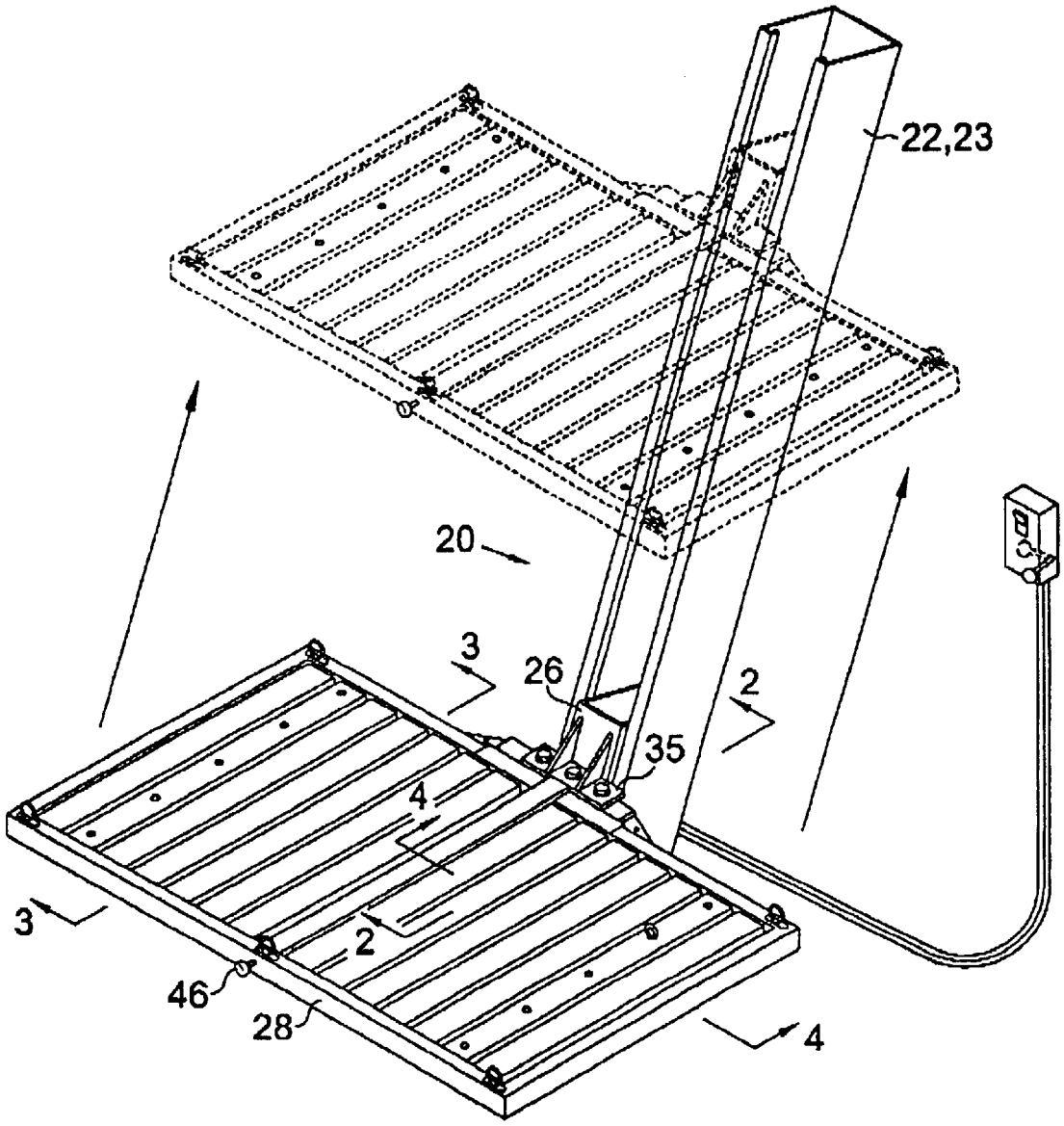
FIG. 1 is a perspective view of a small vehicle storage lift.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a small vehicle storage lift 20. The storage lift 20 for lifting a small vehicle 16 off a floor 18 comprises: an upright track 22 having a base 24 anchored 27 to the floor 18; a carriage 26 slidably connected to the track 22; a deck frame 28 carried by the carriage 26, said deck frame 28 carried by and only by one longitudinal side portion of the deck frame 28; and a deck lift means 30 for motivating the carriage 26 upwardly in the track 22 thereby lifting the deck frame 28.

Most preferably the deck frame 28 is rectangular. Most preferably the invention includes a frame attachment bracket 35 which is carried by the carriage 26. The attachment bracket 35 is centrally and removably connected to one long side portion of the deck frame 28. As shown in FIG. 1 there is one and only one upright track 22. The upright track 22 most preferably comprises a channel 23. The carriage 26 slides centrally within the channel 23. FIG. 1 also shows a mechanical safety latch mechanism 46 to prevent the carriage 26 from unexpectedly sliding down within the upright channel 22.

Figure 2:
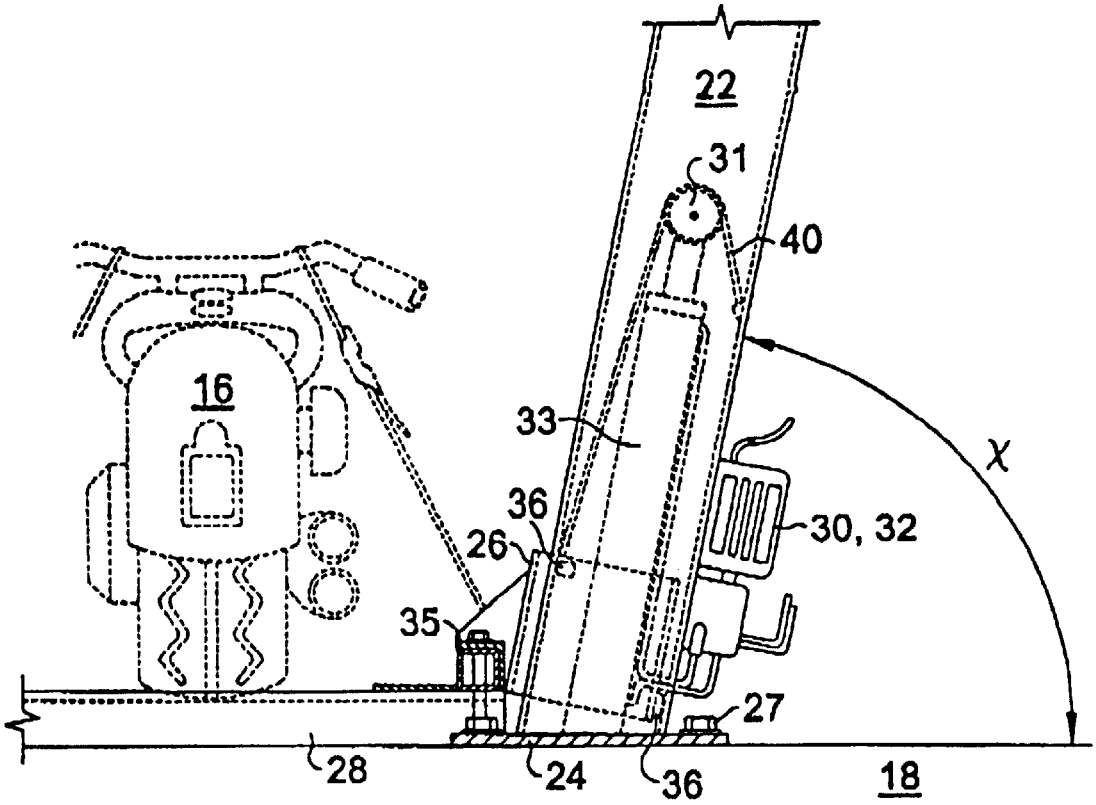
FIG. 2 is a partial cross sectional view as viewed along line 2—2 in FIG. 1.

FIG. 2 is a partial cross sectional view as viewed along line 2—2 in FIG. 1. FIG. 2 shows the attachment of the deck fame 28 to the upright track 22, and the attachment of the upright track 22 to the base 24, and to the floor 18. Most preferably, a top portion of the upright track 22 is tipped laterally away from a bottom portion of the upright track 22 so that as the carriage 26 lifts the deck frame 28, the deck frame's center of gravity will tend to move above the base 24 of the upright track 22. The upright track 22 forms an angle x of generally 60 degrees with the floor. Plastic slides 36 are positioned between the carriage 26 and an internal side of the channel 22.

Looking at FIG. 1 and FIG. 2 we can observe the preferred lift means 30. The preferred lift means 30 comprises a hydraulic pump and motor assembly 32, a hydraulic cylinder 33, a pulley 31 pivotably attached to an upper end portion of the hydraulic cylinder 33 and a carriage lifting cable 40. The carriage lifting cable 40 has one end portion anchored to the upright track 22 and the other end portion connected to the carriage 26, so that as the pulley 31 lifts a central portion of the cable 40, the carriage 26 is lifted twice the height the central portion of the cable 40 is lifted. In the most preferred embodiment of the invention the cylinder 33 has a lift of 28", but with the use of the cable 40 and pulley 31 it is possible to lift the carriage 56".

Figure 3:
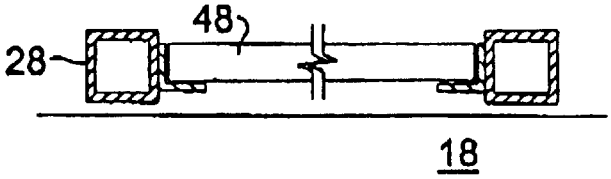
FIG. 3 is a partial lateral cross section of the deck frame, as view along line 3—3 in FIG. 1.
Figure 4:
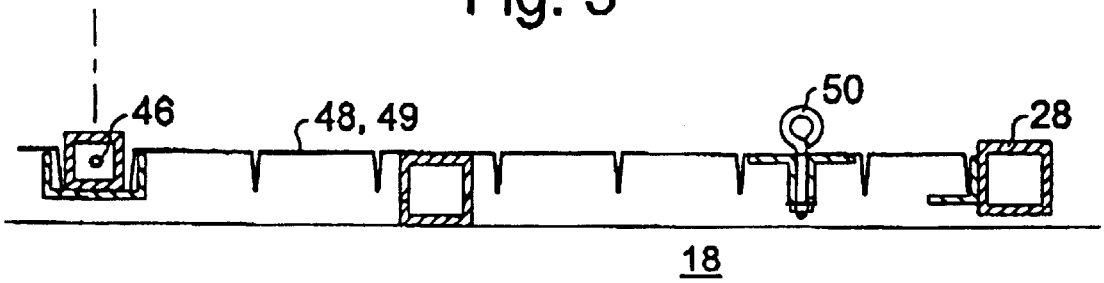
FIG. 4 is a partial longitudinal cross sectional view of the deck frame as viewed along line 4—4 in FIG. 1.

FIG. 3 is a cross sectional view as viewed along line 3—3 in FIG. 1. FIG. 3 shows a lateral cross section of the deck frame 28. FIG. 4 is a cross sectional view as viewed along line 4—4 in FIG. 1. FIG. 4 shows a longitudinal cross section of the deck frame 28. Decking 48 is carried by the deck frame 28. The decking 48 is removable to facilitate inspection and repair of a small motor vehicle 16 lifted thereon. If the decking 48 comprises corrugulated metal 49 which laterally spans the deck frame 28 then a wheel of a vehicle 16 carried thereon will not effortlessly roll off the decking 48. FIG. 4 also shows an optional decking tie down eye 50.

A method of lifting and storing a small vehicle 50 to save floor space on a garage floor 18 comprises the following steps. Anchoring a bottom end portion of an upright track 22 to a garage floor 18. The upright track 22 slidably guides a carriage 26 which carries a deck frame 28. Positioning the small vehicle 50 on the deck frame 28. Lifting the deck frame 28 and the small vehicle 50. Thereafter a car (not shown) may be parked beneath the lifted small vehicle 50.

While the invention has been described with preferred specific embodiments thereof, it will be understood that this description is intended to illustrate and not to limit the scope of the invention, which is defined by the following claims.

I claim:

1. A storage lift for lifting a small vehicle off a floor comprising:

an upright track having a base anchored to the floor;

a carriage slidably connected to the track;

a deck frame carried by the carriage, said deck frame having a center of gravity, and carried by and only by one longitudinal side portion of the deck frame; and a deck lift means for motivating the carriage upwardly in the track thereby lifting the deck frame;

wherein a top portion of the upright track is tipped laterally away from a bottom portion of the upright track so that as the carriage lifts the deck frame, the deck frame's a center of gravity will tend to move above the base of the upright track.

2. A lift as in claim 1 wherein the upright track forms an angle of between 45 and 75 degrees with the floor.

3. A lift as in claim 2 wherein the upright track forms an angle of between 52 and 68 degrees with the floor.

4. A lift as in claim 3 wherein the upright track forms an angle of generally 60 degrees with the floor.

5. A lift as in claim 1 comprising one and only one upright track, and wherein the deck frame is rectangular, and further comprises a frame attachment bracket carried by the carriage, said attachment bracket being centrally and removably connected to one long side portion of the deck frame.

6. A lift as in claim 1 further comprising decking carried by the deck frame, said decking being removable to facilitate inspection and repair.

7. A lift as in claim 6 wherein the decking comprises corrugulated metal laterally spanning the deck frame so that a wheel of a vehicle carried thereon will not effortlessly roll therealong.

8. A lift as in claim 1 wherein the upright track comprises a channel and wherein the carriage slides centrally within the channel.

9. A lift as in claim 8 further comprising plastic slides positioned between the carriage and an internal side of the channel.

10. A lift as in claim 9 wherein the deck lift means comprises a hydraulic pump and motor assembly.

11. A lift as in claim 10 wherein the deck lift means further comprises a hydraulic cylinder, a pulley pivotably attached to an upper end portion of the hydraulic cylinder and a carriage lifting cable, said carriage lifting cable having one end portion anchored to the upright track and another opposite end portion connected to the carriage, so that as the pulley lifts a central portion of the cable, the carriage is lifted twice the height the central portion of the cable is lifted.

12. A lift as in claim 11 further comprising a mechanical safety latch mechanism to prevent the carriage from unexpectedly sliding down within the upright channel.

13. A method for lifting and storing a small vehicle to save floor space on a garage floor comprising the following steps: providing an upright track, a carriage slidably connected to the track, a deck frame carried by the carriage by one and only one longitudinal side portion of the deck frame, a deck lift means for motivating the carriage upwardly in the track thereby lifting the deck frame, wherein a top portion of the upright track is tipped laterally away from a bottom portion of the upright track so that as the carriage lifts the deck frame, a center of gravity of the deck frame will tend to move above the base of the upright track; anchoring a bottom end portion of an upright track to the garage floor; positioning the small vehicle on the deck frame; and finally, lifting the deck frame and the small vehicle; so that the garage floor beneath the lifted small vehicle may be utilized for other purposes.

* * * * *